United States Patent [19]

Betsui

[11] Patent Number: 4,753,612

[45] Date of Patent: Jun. 28, 1988

[54] DOUBLE LOCK ELECTRICAL CONNECTOR

[75] Inventor: Kazuhisa Betsui, Tokyo, Japan

[73] Assignee: AMP Incorporated, Harrisburg, Pa.

[21] Appl. No.: 69,810

[22] Filed: Jul. 6, 1987

[30] Foreign Application Priority Data

Jul. 21, 1986 [JP] Japan ..... 61-171481

[51] Int. Cl.[4] ..... H01R 11/00

[52] U.S. Cl. ..... 439/596; 439/595

[58] Field of Search ..... 439/592–596, 439/603, 142

[56] References Cited

U.S. PATENT DOCUMENTS

| | | | |
|---|---|---|---|
| 3,693,134 | 9/1972 | Trevisiol | 339/59 M |
| 3,825,880 | 7/1974 | Battaglia et al. | 439/595 |
| 4,045,112 | 8/1977 | Rodondi et al. | 439/595 |
| 4,114,971 | 9/1978 | Heimbrock | 439/596 |
| 4,200,350 | 4/1980 | Zimmerman, Jr. | 439/357 |
| 4,243,287 | 1/1981 | Smith et al. | 439/595 |
| 4,253,719 | 3/1981 | McGinley | 439/593 |
| 4,329,009 | 5/1982 | Bungo | 439/595 |
| 4,413,872 | 11/1983 | Rudy, Jr. et al. | 339/59 M |
| 4,449,773 | 5/1984 | Esser et al. | 339/59 M |
| 4,660,914 | 4/1987 | Nakamura | 439/596 |
| 4,679,874 | 7/1987 | Saijo et al. | 439/595 |
| 4,705,337 | 11/1987 | Maeda | 439/595 |

FOREIGN PATENT DOCUMENTS

| | | | |
|---|---|---|---|
| 0058237 | 8/1982 | European Pat. Off. | 439/603 |
| 1315693 | 5/1973 | United Kingdom . | |
| 2071926A | 9/1981 | United Kingdom . | |

*Primary Examiner*—Eugene F. Desmond
*Assistant Examiner*—Paula A. Austin
*Attorney, Agent, or Firm*—A. John LaRue; Robert W. Pitts

[57] ABSTRACT

An electrical connector housing (10) for maintaining an electrical contact (2,6) in position in a contact-retaining passage (12,16) therein comprises locking members (20,30) hingedly mounted onto sides of the housing for closing locking openings (**13*a*,13*b*,17*a*,17*b*) in the sides of the housing, the locking openings being in communication with the contact-retaining passage. Locking projections (21,22,31,32) are located on the locking members (20,30) for engagement with the contact (2,6) when the locking members (20,30) close the locking openings thereby maintaining the contact (2,6) in position in the passage (12,16). Resilient latching members (23,33) are provided on the locking members (20,30) and they include latching sections (23*a*,33*a*) that latchably engage with one another in the housing (10) when the locking members (20,30) are in a closed position thereby maintaining the locking members (20,30**) in the closed position.

3 Claims, 4 Drawing Sheets

DOUBLE LOCK ELECTRICAL CONNECTOR

FIELD OF THE INVENTION

This invention is related to an electrical connector. More particularly, it is related to a double lock electrical connector.

BACKGROUND OF THE INVENTION

Double lock type electrical connectors, for example, for electrically wiring cars, have been widely used. The double lock type connector is provided with a resiliently deformable lance in a contact-retaining passage of a connector housing, and a locking member joined by a hinge to the connector housing. Therefore, when an electrical contact, one end of which is connected to a wire, is inserted into the contact-retaining passage, the contact is retained in the passage by the lance, which engages with a shoulder of the contact by a resilient force of the lance, and is locked in the passage by the locking member. Thus, the contact is maintained within the passage. Further, the locking member has a locking projection, which engages the shoulder of the contact by projecting into the contact-retaining passage through an opening of the housing. Thus, the contact is double locked and retained in the passage. Accordingly, since the contacts are securely retained in the passages by this double-locking arrangement, this connector is widely used for wiring harnesses which may be affected by a pulling force, for example, the wiring harness of a car.

In the above double lock connector, when the contacts are locked and retained by the locking member, the contacts are locked and retained by the locking projection inside the contact-retaining passage of the housing when the locking member is moved to a closed position. At this time, it is necessary to retain the locking member in the locking position. Therefore, latching sections on the locking member and housing of the known connector, hold the locking member in the locking position by these latching sections being engaged when the locking member is moved to the locking position. Thus, the locking member is latched and retained by the housing.

However, when the contacts are arranged vertically in two rows in the housing, sometimes the locking members are located at both sides of the housing. In this case, each locking member must be latched with the housing to be retained in the locking position. Thus, since the contacts used for the wiring of, for example, a car are very small and the connector housing is also small, it is difficult to manufacture such a small housing having the latching sections on both locking members respectively, because the latching sections must also be small. Further, a problem arises in that this latching arrangement may be incomplete and apt to be unlatched if the size of the latching sections is small.

SUMMARY OF THE INVENTION

In consideration of above-mentioned problems, the purpose of this invention is to securely retain both locking members in the locked position when the locking members are hinged to sides of the housing.

In the connector according to this invention, the housing is provided with contact-retaining passages which extend from the back to the front thereof, and locking openings are located in both sides of the housing. Further, at both sides of the housing, locking members which close the locking openings are hinged thereto, and locking projections project are located on the locking members. These locking projections inside the contact-retaining passages and lock and retain the contacts inserted in the contact-retaining passages by engaging with the contacts when the locking members are moved to a closed position thereby closing the locking openings. One of the locking members is provided with a first resilient member having a latching projection and the other locking member is provided with a second resilient member having an aperture. When the locking members are respectively closed to close the locking openings, the first and second resilient members are moved with the locking members and at least a portion of each resilient member is located outside of the contact-retaining passages, thus the latching projection is latchably engaged with the aperture and maintained in this position such that both resilient members are latched together, thereby maintaining both locking members in the closed position.

In the connector explained above, both locking members are maintained in the locking position by the engagement of the first and the second resilient members on both locking members when the contacts inserted in the contact-retaining passages are retained in the locked position by the locking members, which are hinged to both sides of the housing. Thus, the latching engagement of the locking members with the housing is not necessary, and further, the two locking members can be maintained in the locked position by latching engagement at one position. Therefore, the latching sections can be made larger in order to securely maintain the locking members in the locking position.

DETAILED DESCRIPTION OF THE INVENTION

Figure 1:
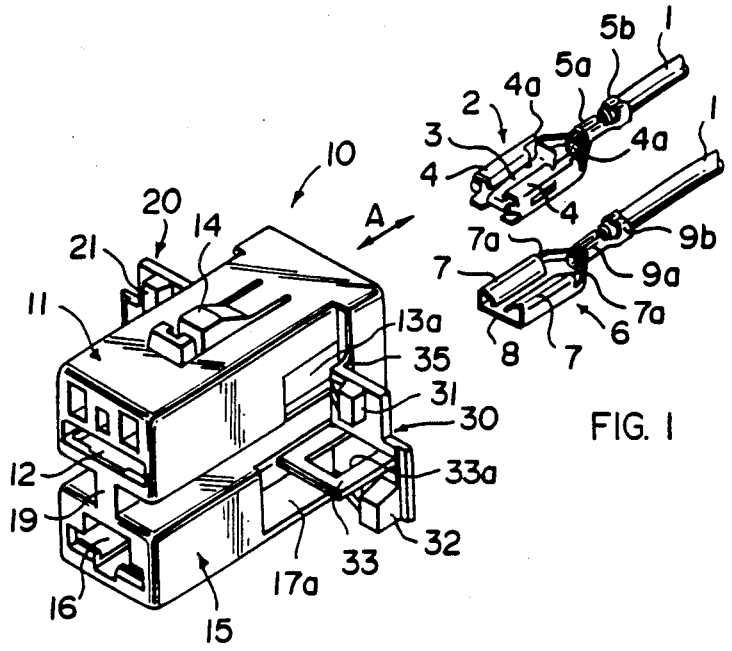
FIG. 1 is a perspective exploded view of the connector according to this invention prior to assembly.

The following is a description of a preferred embodiment of this invention by way of example with reference to the drawings.

This connector comprises a connector housing 10 and first and second receptacle contacts 2,6 having electrical wires 1 connected thereto. Connector housing 10 has first and second housings 11,15 arranged vertically which are integrally linked by a rib 19. First and second contact passages 12,16 extend through (in the directions shown by the arrow A) the first and the second housings 11,15 respectively. Further, at both the sides of the first and second housings 11,15, first locking openings **13*a*, and second locking openings 17*a* (it being understood that equivalent openings are located on the rear side of the housing as seen in FIG. 1) are located which communicate with the first and the second contact-retaining passages 12,16** respectively.

Locking members 20,30 are pivotably mounted at rear sides of the locking openings via integral hinges 25,35, which extend in the vertical direction. Thus, locking openings 13*a*,13*b*,17*a*,17*b* can be closed and opened by these locking members 20,30. Details of locking members 20,30 will be explained hereafter.

In this connector, first and second receptacle contacts 2,6 are inserted into first and second contact passages 12,16 respectively from the rear end of housings 11,15 as shown in FIG. 1.

Figure 3:
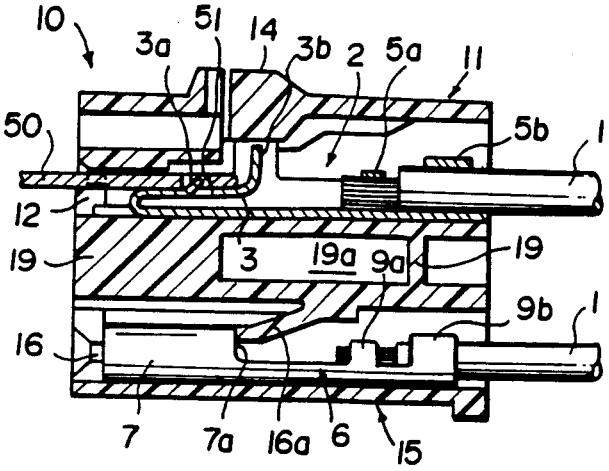
FIGS. 3 and 4 are cross-sectional views taken along lines III—III and IV—IV of FIG. 2.
Figure 4:
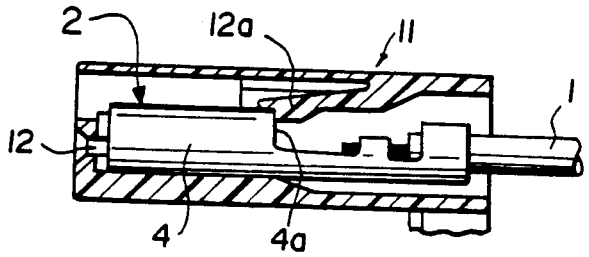

First, a conductor and an insulation of a wire 1 are respectively engaged by wire-connecting tabs 5*a*,5*b* formed at the rear end of first receptacle contact 2, which is inserted in first contact-retaining passage 12 as shown in FIGS. 3 and 4. A tab 50 of a connecting terminal of a complementary plug connector is received and held by a center resilient tongue 3 at the front end and by tab-engaging members 4. Center tongue 3 is formed by a bottom plate folded back on itself and having an inner end 3*b* which extends upward opposite the bottom surface of a release lever 14 of housing 11, as shown in FIG. 3.

Lever 14 is pivotably supported at one end by first housing 11. Thus, when lever 14 is pressed down, the inner end 3*b* of center tongue 3 is also pressed down. A latching projection 3*a* is located at the center portion in the lateral direction of center tongue 3. When latching projection 3*a* enters latching hole 51 of tab 50, it is latchingly maintained between center tongue 3 and tab-engaging members 4. Tab 50 can be removed by pressing down on lever 14, which presses down the inner end 3*b* of center tongue 3 and disengages latching projection 3*b* from latching hole 51; thus, tab 50 can be pulled out from contact 2. Also, a pair of first resilient lances 12*a* projecting frontward inside first contact-retaining passage 12 extend integrally from an upper surface of first contact-retaining passage 12, as shown in FIG. 4. Inner ends 4a of tab-engaging members 4 of receptacle contact 2 are engaged by shoulders of lances 12*a* thereby maintaining contact 2 in position in passage 12.

The second receptacle contact 6, which is inserted in the second contact-retaining passage 16, terminates the conductor and the insulation of the wire 1 by the wire-connecting tabs 9*a*,9*b* respectively, formed at the rear end thereof. Contact 6 electrically connects the tab of the connecting terminal of the complementary plug connector between tab-engaging members 7 and bottom member 8, as shown in FIG. 1. A second integral resilient lance 16*a* extends frontward from the upper surface at a central location of second contact-retaining passage 16, as shown in FIG. 3. When second receptacle contact 6 is inserted in second contact-retaining passage 16 from the rear end thereof, the inner ends 7*a* of tab-engaging members 7 are engaged by the free end of second resilient lance 16*a* thereby maintaining contact 6 in position in passage 16.

Figure 2:
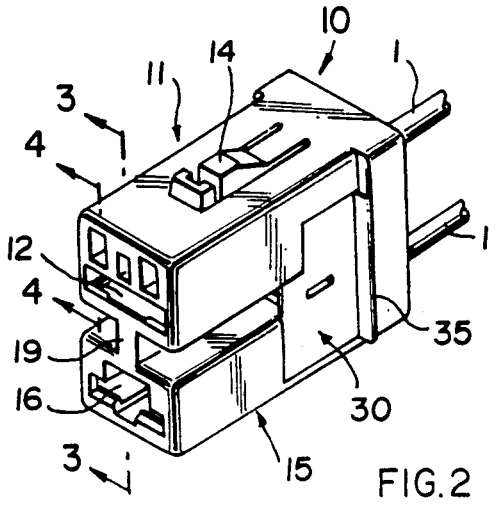
FIG. 2 is a perspective view of the connector of FIG. 1 in an assembled condition.
Figure 5:
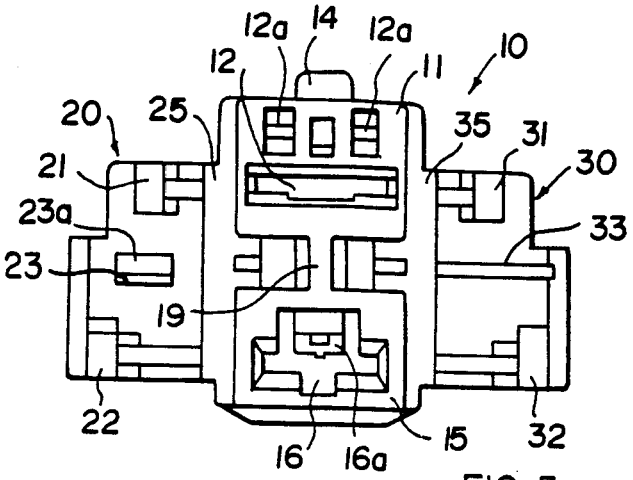
FIGS. 5 and 6 are a front view and a top view respectively showing the housing of the connector.
Figure 6:
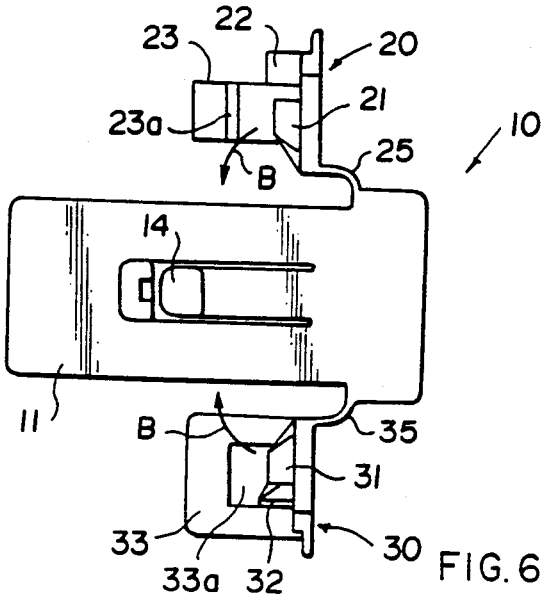

As explained above, one of the locking structures is composed of the first and second resilient lances 12*a*,16*a*. The following is an explanation of the locking members 20,30 which constitute the other locking structure. The locking members 20,30 are explained with reference to FIGS. 5 and 6 whereby locking members 20,30 are pivotably joined with housing 10 through integral hinges 25,35. In the locking position, when locking members 20,30 are moved in the direction of arrows B (FIG. 6), locking members 20,30 are in the closed position whereby first and second locking openings 13*a*,17*a*, are covered, as shown in FIG. 2. Each locking member 20,30 is provided with first locking projections 21,31 and second locking projections 22,32 at the top and bottom thereof respectively, and these projections project inside the first and the second contact-retaining passages 12,16 through first and second locking openings 13*a*,17*a*, when locking members 20,30 are in the closed position. Accordingly, the front end surfaces of locking projections 21,31,22,32 projecting inside first and second contact-retaining passages 12,16 engage with the inner ends 4*a*,7*a* of tab-engaging members 4,7 of first and second receptacle contacts 2,6, thereby assuring that the contacts are maintained in the passages.

Figure 7A:
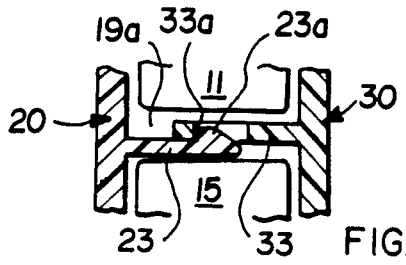
FIGS. 7A and 7B are cross-sectional views showing the resilient latching members in a latched position maintaining the locking members of the connector at a closed position.

Accordingly, the second locking arrangement is realized when the first and second locking members 20,30 are moved into the closed position, but first and second locking plates 20,30 must be maintained in the closed position in order to maintain them in a locking position. Therefore, a first resilient member 23 having a latching projection 23*a* and a second resilient member 33 having an aperture 33*a* are respectively integral with first and second locking members 20,30. When locking members 20,30 are moved from the open position to the closed position, both resilient members 23,33 extend inside an aperture 19*a* in rib 19 and as shown in FIG. 7A, latching projection 23*a* is disposed within aperture 33*a*. Accordingly, first and second locking members 20,30 are maintained in the closed position by resilient members 23 and 33 being latched together via latching projection 23*a* and aperture 33*a*.

Figure 7B:
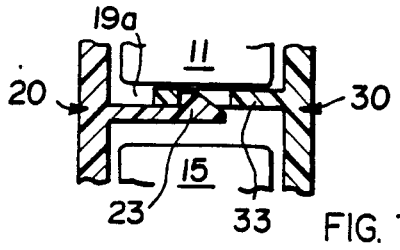
Figure 8A:
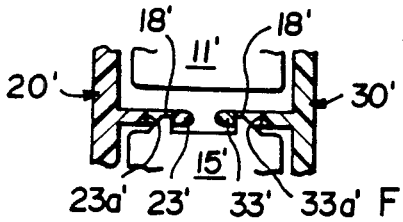
FIG. 8a PRIOR ART
FIGS. 8A and 8B are cross-sectional views showing the latching arrangement for the locking members of a prior art connector.
Figure 8B:
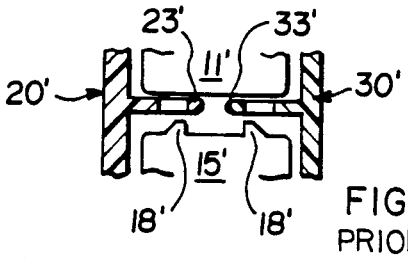
FIG. 8b PRIOR ART

FIG. 8A shows locking members 20',30' latched and maintained in position of a prior art connector. As shown in FIG. 8A, latching apertures 23*a*',33*a*' of resilient members 23',33' of locking members 20',30' are latchably engaged with latching projections 18' on housing 15'. In this structure, resilient members 23',33' must be made smaller because latching projections 18' cannot be made larger. Thus, this latching arrangement is not reliable in comparison with that of the present invention. Namely, since the latching takes place at only one location in the present invention, the latching aperture and the latching projection can be made larger, thus both resilient members can be securely latched together. Moreover, if the housing is bent by, for example, an external force or heat, the latching arrangement is still maintained, as shown in FIG. 7B, because latching of resilient members 23,33 with housing 15 is not required in this invention. Conversely, in the prior art connector, resilient members 23',33' are apt to become unlatched from latching projections 18' as shown in FIG. 8B. Although a connector having two contacts is used in the description of this invention, the invention can be also applied to connectors having one contact or more than three contacts. Also, a double lock type connector in which the contacts inserted in the contact-retaining passages are locked by resilient lances and the locking members are used in the description of this invention, it is to be noted that this invention can also be applied to a connector in which the locking is not made by the resilient lance but by the locking members.

As explained above, according to this invention, electrical contacts are locked and maintained by locking projections on locking members integrally hinged to sides of the housing, when the locking members are in the closed position, because the locking members are maintained in a closed position by latching engagement of the latching apertures and latching projections on first and second resilient members on the locking members. Thus, latching engagement of the locking members with the housing is not required. Also, unlatching of the resilient members caused by, for example, bending of the housing, does not occur. Further, latching of the resilient members is very good since the latching apertures and the latching projections can be made larger because the locking members are maintained in the closed position at only one location.

I claim:

1. An electrical connector housing (10) for maintaining an electrical contact (2,6) in position in a contact-retaining passage (12,16) therein, comprising:

locking members (20,30) hingedly mounted onto sides of said housing (10) for closing locking openings (**13*a*,13*b*,17*a*,17*b*) in the sides of the housing, said locking openings being in communication with said passage (12,16**);

locking projections (21,22,31,32) on said locking members (20,30) for engagement with the contact (2,6) when said locking members (20,30) close said locking openings (**13*a*,13*b*,17*a*,17*b*) thereby maintaining the contact (2,6) in position in the passage (12,16); and resilient latching members (23,33) on said locking members (20,30) and having latching sections (23*a*,33*a*) that latchably engage with one another in said housing (10) when said locking members (20,30) are in a closed position thereby maintaining the locking members (20,30**) in the closed position.

2. An electrical connector housing as claimed in claim 1, wherein said latching sections (**23*a*,33*a*) are in the form of a latching projection (23*a*) on one of said resilient latching members (23,33) and a latching aperture (33*a*) in the other of said resilient latching members (23,33**).

3. An electrical connector housing as claimed in claim 1, wherein said contact-retaining passage (12,16) has an integral resilient lance (**12*a*,16*a*) for engagement with the electrical contact (2,6) for initially maintaining the contact (2,6) in said passage (12,16**).

* * * * *